United States Patent [19]

Seibt

[11] 4,177,113

[45] Dec. 4, 1979

[54] METHOD OF ELECTROFORMING SHEETS AND SELF-STRIPPING CATHODE

[75] Inventor: Willie Seibt, Edmonton, Canada

[73] Assignee: Sherritt Gordon Mines Limited, Toronto, Canada

[21] Appl. No.: 928,347

[22] Filed: Jul. 27, 1978

[30] Foreign Application Priority Data

Apr. 28, 1978 [CA] Canada ..... 302292

[51] Int. Cl.[2] ..... C25D 1/04; C25D 1/20

[52] U.S. Cl. ..... 204/12; 204/281

[58] Field of Search ..... 204/281, 286, 288, 289, 204/290 R, 12, 105 R, 106, 114

[56] References Cited

U.S. PATENT DOCUMENTS 3,763,030 10/1973 Zimmer ..... 204/11

FOREIGN PATENT DOCUMENTS 8108 of 1893 United Kingdom ..... 204/9

*Primary Examiner*—R. L. Andrews

*Attorney, Agent, or Firm*—Robert F. Delbridge; Arne I. Fors

[57] ABSTRACT

A cathode has a hollow body with opposed, spaced sheet-like parallel walls with outer faces on which metal is deposited during use of the cathode. The body has outer surfaces between the outer faces of the walls upon which substantially no metal is deposited during use of the cathode, so that metal is deposited as two separate sheets, one sheet on each wall. The hollow body is connectable to a source of reduced air pressure and the sheet-like walls are resiliently deformable to enable the walls to be inwardly bowed towards one another by reduced air pressure, after metal has been deposited on the walls, so as to effect separation of the deposited metal sheets from the walls.

6 Claims, 6 Drawing Figures

FIG.1.
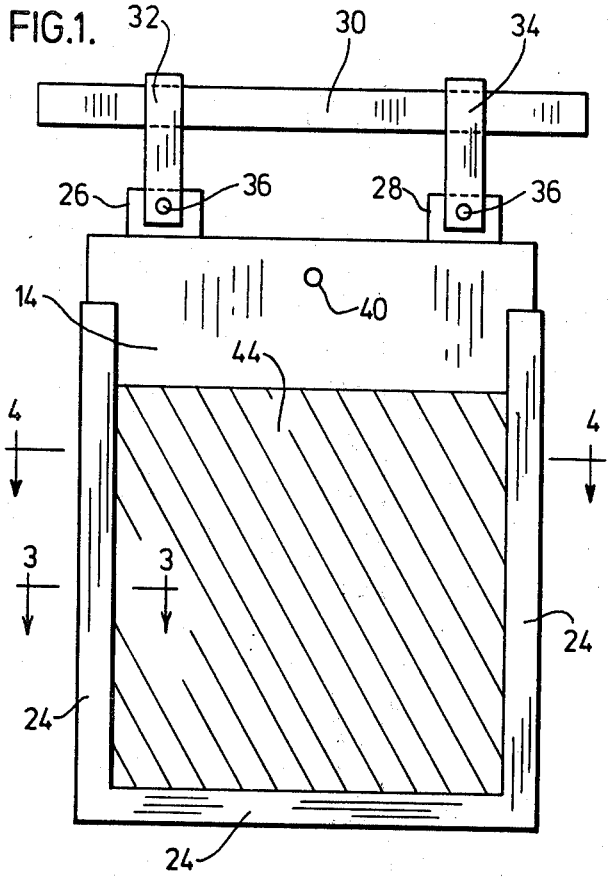
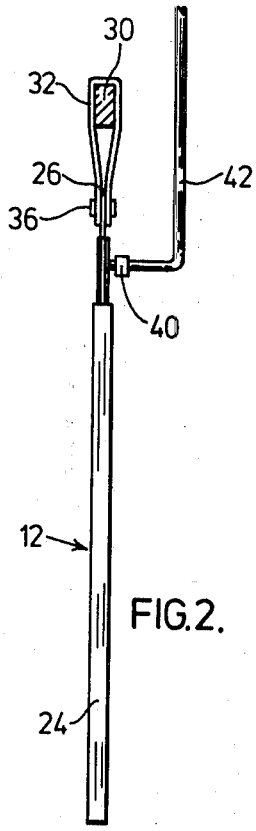
FIG.2.
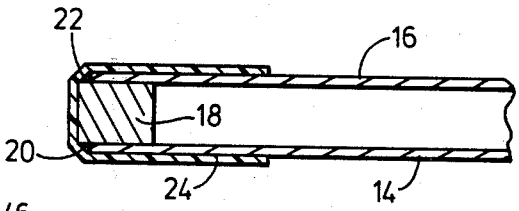
FIG.3.
FIG.4.
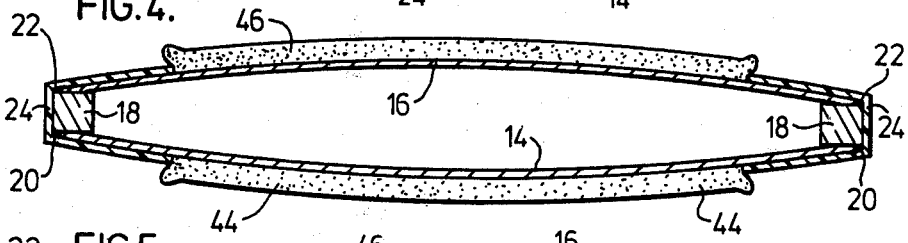
FIG.5.
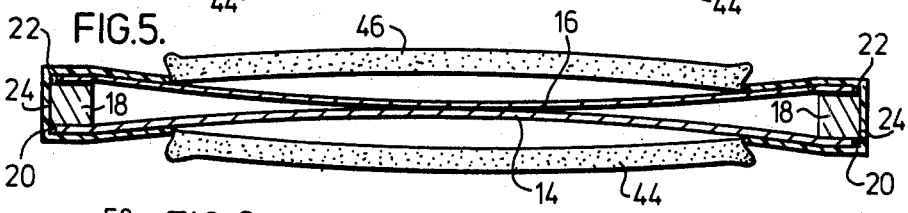
FIG.6.
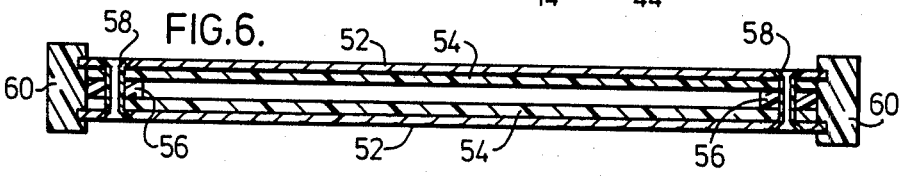

METHOD OF ELECTROFORMING SHEETS AND SELF-STRIPPING CATHODE

This invention relates to cathodes for use in the electrode position of metals, and to the removal of deposited metal from such cathodes.

Metallurgical processes for the recovery of metals such as copper and zinc often include electrolysis as a final step in the process, the metal being deposited on the cathode during electrolysis of a metal-containing solution of suitable purity and concentration. On a commercial scale, such electrolysis is carried out in a so-called cell-house which contains a large number of electrolytic cells, and hence a large number of cathodes. Conventionally, the cathodes are plate-like in shape, with metal being deposited on both sides.

The removal of deposited metal from cathodes in electrolysis on a commercial scale has always been a problem. The weight of metal deposited on each side of a cathode may, in a commercial operation, be of the order of 100 pounds or more. One problem therefore is immediately apparent, namely that of handling the cathode and the metal deposited thereon. Another problem lies in the separation of the metal deposit from the cathode. In smaller scale operations, a starter sheet made of the same metal as the metal to be deposited may be used as the cathode structure in a readily removable manner so that the metal is deposited on the starter sheet during the electrolysis operation. After the operation, the starter sheet and deposited metal can readily be removed. However, this method is not particularly economical since the starter sheets themselves have to be produced by electrolysis and prepared for attachment to the cathode structure. Also, such starter sheets are relatively thin and frequently become out of shape in use, because of their lack of rigidity, with consequent risk of an electrical short circuit occurring in an electrolytic cell. Further, the weight of metal which can be deposited on such starter sheets is limited because of this weakness.

On a larger scale, rigid strippable cathodes are usually used, being made for example of titanium. However, such cathodes are expensive, and are frequently damaged by the stripping of deposited metal therefrom by manual or mechanical means. The stripping operation with known cathodes takes a considerable time and because of the damage frequently caused in the stripping operation their life is relatively short.

It is therefore an object of the invention to provide a cathode of relatively inexpensive construction which is robust and from which deposited metal can be readily removed.

According to the invention, a cathode has a hollow body with opposed, spaced sheet-like parallel walls with outer faces on which metal is deposited, the walls being resiliently deformable towards and away from one another, and the body having outer surfaces between the outer faces of the walls upon which substantially no metal is deposited during use of the cathode so that metal is deposited on the cathode as two separate sheets, namely one sheet on each of the spaced parallel walls. After metal has been deposited on the walls, the hollow body is connected to a source of reduced air pressure so as to inwardly bow the walls towards one another, so as to effect separation of the deposited metal sheets from the walls. The hollow body may also be connected to a source of increased pressure during deposition of the metal such that the walls are slightly outwardly bowed during deposition of the metal.

Each sheet-like wall may consist of a metal sheet or, alternatively, may consist of an outer metal sheet bonded to an inner non-metallic substrate sheet. The outer surfaces upon which substantially no metal is deposited may be formed by non-conductive material, for example, a coating of non-conductive material on a metallic part of the cathode.

With a cathode according to the present invention, not only is the cathode readily strippable, but it is also of robust and relatively inexpensive construction. For example, the sheet-like walls may be formed by stainless steel sheets.

Embodiments of the present invention will now be described, by way of example, with reference to the accompanying drawings, of which:

FIG. 1 is a front view of a cathode according to one embodiment;

FIG. 2 is a side view of the cathode,

FIG. 3 is a sectional view along the line 3—3 of FIG. 1, but on an enlarged scale, showing the manner in which the cathode is constructed, FIG. 4 is a sectional view along the line 4—4 of FIG. 1 showing the configuration of the cathode during electrolysis, FIG. 5 is a similar view, but showing the configuration of the cathode during stripping, and FIG. 6 is a sectional view showing a cathode in accordance with another embodiment.

Referring first to FIGS. 1 to 5, a cathode has a hollow body 12 with opposed parallel walls formed by rectangular sheets 14, 16 of stainless steel. The walls 14, 16 are separated by a stainless steel strip 18 extending completely around the periphery of the walls 14, 16 and welded thereto by peripherally extending welds 20, 22, thereby forming a hollow box-like structure. The side edges and bottom edge of the body 12 and adjacent edge portions of the rectangular sheets 14, 16 are coated with polyurethane or soft polyvinylchloride which forms a non-conductive mask 24 providing non-conductive surfaces between the conductive walls 14, 16.

A pair of horizontally spaced steel ears 26, 28 are welded to the top of the body 12 and extend upwardly therefrom. A copper header bar 30 is connected to the body 12 by a pair of copper straps 32, 34 that pass around the heater bar 30 and are secured to respective ears 26, 28 by bolts 36, 38.

A tubular fitting 40 is screwed into a tapped hole in the wall 14 near the top to provide communication with the interior of the hollow cathode body 12, the tubular fitting 40 having a flexible tube 42 extending therefrom.

In use, the cathode is positioned in an electrolytic cell with the flexible tube 42 connected to a source of low pressure, for example, 0.5 to 1.0 psig, so that the hollow body 12 is slightly expanded by outward bowing of the walls 14, 16, as shown in FIG. 4. A normal electrolysis operation is then carried out, with the result that sheets of metal 44, 46 are deposited on the walls 14, 16 respectively. Each metal sheet 44, 46 is rectangular, with its bottom and side edges abutted by the non-conductive strip 24, and with its upper edge determined by the depth of immersion of the cathode in the solution in the electrolytic cell.

After sufficient metal has been deposited on each wall 14, 16 of the cathode, the cathode is removed from the electrolytic cell and the low excess pressure in the hollow body 12 is released. The flexible tube 42 is then connected to a source of reduced pressure, for example a vacuum of 12 to 14 inches of mercury, to cause the walls 14, 16 to bow inwardly. The reduced pressure may be of such a value that the walls 14, 16, bow inwardly until they touch one another, as shown in FIG. 5. The metal deposits 44, 46, which of course are in sheet form, then either become completely separated from the walls 14, 16, or become almost completely separated so that their removal is a simple matter.

It can therefore be readily understood how stripping of cathodes is facilitated by use of the present invention. The less likelihood of damage to a cathode constructed and stripped in accordance with the present invention can also be readily appreciated. The time required to strip such cathodes is also relatively short compared to the time required for cathodes known in the prior art. Also, the simplicity of construction results in a relatively small cost of production and a relatively long life. For example, several cathodes may be stripped simultaneously in such a manner that the stripped metal falls onto a conveyor belt.

Taking into account the large number of cathodes used in a commercial operation, the advantages of the present invention when used on a commercial scale are self-evident. Further, since the metal deposited does not have to be manually handled, the weight of metal deposited is not so limited as in the prior art, with the result that more metal can be deposited on a cathode according to the present invention. This means that the cathodes do not have to be stripped so frequently, and can be operated in an electrolytic cell for a longer period of time.

The deformable walls 14, 16 may be made of any suitable material. For example, stainless steel is particularly suitable for the deposition of copper, with aluminum being particularly suitable for the deposition of zinc. Both stainless steel and aluminum sheet are, of course, relatively inexpensive.

When a surface of a more expensive metal such as titanium is required for the walls 14, 16 of the cathode, the walls may be constituted by a thin outer sheet of metal bonded to an inert, non-conductive substrate sheet. For example, in the embodiment shown in FIG. 6, each wall comprises a titanium sheet 52 bonded to a fiber-reinforced plastic substrate sheet 54. The substrate sheets 54 are spaced apart by plastic spacer strips 56, and the walls and spacer strips 56 are held in assembly by non-conductive rivets 58. The edges of the titanium sheets 52 are engaged in grooves in side strips 60.

Various other embodiments within the scope of the invention will be readily apparent to one skilled in the art, the scope of the invention being defined in the appended claims.

What I claim as new and desire to protect by Letters Patent of the United States is:

1. A method of obtaining a metal from a solution thereof by electrodeposition on a cathode, including depositing said metal on a cathode having a hollow body with opposed, spaced sheet-like parallel walls with outer faces, said body having outer surfaces between said outer faces of said walls upon which substantially no metal is deposited during use of the cathode so that metal is deposited as two separate sheets, one sheet on each wall, said walls being resiliently deformable, and connecting the hollow body to a source of reduced pressure, after metal has been deposited on said walls, to cause said walls to bow inwardly towards one another with resultant separation of the deposited metal sheets from the walls.

2. A method according to claim 1 wherein the hollow body is connected to a source of increased pressure during electrodeposition of the metal such that the walls are slightly outwardly bowed during electrodeposition.

3. A cathode for use in the electrodeposition of metals, having a hollow body with opposed, spaced sheet-like parallel walls with outer faces on which metal is deposited during use of the cathode, said body having non-conductive outer surfaces between said outer faces of said walls upon which substantially no metal is deposited during use of the cathode, so that metal is deposited as two separate sheets, one sheet on each wall, the hollow body being connectable to a source of reduced air pressure and the sheet-like walls being resiliently deformable to enable the walls to be inwardly bowed towards one another by reduced air pressure, after metal has been deposited on said walls, so as to effect separation of the deposited metal sheets from the walls.

4. A cathode according to claim 1 wherein each sheet-like wall consists of a metal sheet.

5. A cathode according to claim 1 wherein each sheet-like wall consists of an outer metal sheet bonded to an inner non-metallic substrate sheet.

6. A cathode according to claim 1 wherein said surfaces are formed by a coating of non-conductive material on a metallic part of the cathode.

* * * * *